US006622120B1

(12) United States Patent
Yoon et al.

(10) Patent No.: US 6,622,120 B1
(45) Date of Patent: Sep. 16, 2003

(54) FAST SEARCH METHOD FOR LSP QUANTIZATION

(75) Inventors: Byung Sik Yoon, Taejon (KR); Sang Won Kang, Kyoungki-do (KR); Chang Yong Son, Seoul (KR); Hyoung Jung Kim, Taejon (KR); Jung Chul Lee, Taejon (KR)

(73) Assignee: Electronics and Telecommunications Research Institute, Taejon (KR)

( * ) Notice: Subject to any disclaimer, the term of this patent is extended or adjusted under 35 U.S.C. 154(b) by 0 days.

(21) Appl. No.: 09/498,998

(22) Filed: Feb. 4, 2000

(30) Foreign Application Priority Data

Dec. 24, 1999 (KR) ..... 1999-62269

(51) Int. Cl.[7] ..... G10L 19/12
(52) U.S. Cl. ..... 704/222; 704/230
(58) Field of Search ..... 704/219, 222, 704/230, 243, 244

(56) References Cited

U.S. PATENT DOCUMENTS 5,194,864 A * 3/1993 Nakano ..... 341/106
5,819,224 A * 10/1998 Xydeas ..... 704/222
5,822,723 A 10/1998 Kim et al. ..... 704/222
6,067,515 A * 5/2000 Cong et al. ..... 704/243
6,148,283 A * 11/2000 Das ..... 704/222
6,269,333 B1 * 7/2001 Ravishankar ..... 704/222

OTHER PUBLICATIONS

Paliwal et al., "Efficient Vector Quantization of LPC Parameters at 24 Bits/Frame," *IEEE Transactions on Speech and Audio Processing, 1*(1):3–14, Jan., 1993.

* cited by examiner

*Primary Examiner*—Marsha D. Banks-Harold
*Assistant Examiner*—Angela Armstrong
(74) *Attorney, Agent, or Firm*—SEED IP Law Group PLLC

(57) ABSTRACT

A fast search method for LSP (Linear Spectrum Pair) quantization is provided. The fast search method in accordance with an embodiment of the present invention includes the following steps. A first step is obtaining a target vector and a code vector. The target vector and the code vector are converted for ordering property. A second step is generating a code book having the ordering property for sub-matrices by utilizing the target vector and the code vector. A third step is selecting a particular line for determining a search scope in the code books and sorting the code book in descending order with respect to component values of the particular line. A fourth step is determining the search scope by utilizing the ordering property of the target vector and the sorted code vectors. The fifth step is obtaining an error standard by utilizing the target vector and the code vector, and obtaining an optimal code vector by utilizing the error standard within the determined search scope.

13 Claims, 12 Drawing Sheets

FAST SEARCH METHOD FOR LSP QUANTIZATION

TECHNICAL FIELD

The present invention relates to a voice coder using PSMQ (predictive split matrix quantization) and PSVQ (predictive split vector quantization) of LSP (line spectrum pair) coefficient. In particular, the present invention relates to a fast search method for LSP quantization in PSMQ or PSVQ.

BACKGROUND OF THE INVENTION

Generally, voice-coding methods with analysis-by-synthesis structure extract parameters that represent voice signal and quantize the parameters for transmission. The voice-coding methods reduce the amount of data to be transmitted in environments of limited bandwidth.

In order to perform high quality voice coding, low speed voice coders should quantize LPC (linear predictive coding) coefficients efficiently. LPC coefficients describe the relativity of voice signals in short range. Optimal LPC coefficients are obtained in the following way. First, the input voice signal is divided into frame units. Then, LPC coefficients are obtained as the energy of expectation error is minimized in each frame. Generally, LPC filters are to the $10^{th}$ order, all-pole filters and a number of bits are allocated to quantize the 10 LPC coefficients. For example, in the case of IS-96A QCELP, which is a voice coding method in CDMA mobile communication systems, 25% of the total bits are used for LPC quantization.

So far, a number of methods have been proposed for LPC coefficient quantization, and they are practically used for voice coders. The methods, in which LPC coefficients are directly quantized, are too sensitive for quantization error of coefficients and there is no guarantee that LPC filters are stable after quantization.

Therefore, LPC coefficients should be converted into different parameters having good quantization characteristics, and usually they are converted into reflection coefficients or LSP (line spectrum pairs). Especially, since LSP is closely related with frequency characteristics of voice signals, recently developed standard voice coders mostly employ LSP quantization methods.

In addition, more efficient quantization is possible by using correlation of LSP between frames. That is, the LSP of the current frame is not directly quantized. Instead, the LSP of the current frame is expected on the basis of LSP information regarding previous frames and the difference of the LSP expected between the two frames is quantized. The LSP value may be expected in terms of time because it is heavily related with frequency characteristics of voice signals and it results in a relatively high expectation gain.

Here, the two LSP expectation methods are explained. One is using an AR (auto-regressive) filter and the other method uses an MA (moving average) filter. AR filters are superior to MA filters in expectation capability yet it is problematic because the effect of the coefficient error propagates through frames. On the contrary, though expectation capability of MA filters is not as good as one of the AR filters, MA filters are advantageous in that the effect of a coefficient error is restricted in terms of time. Consequently, voice coders used in a wireless communication environment like AMR, CS-ACELP, and EVRC usually employ MA filters for LSP expectation.

In addition, other than expecting LSP value between frames, a quantization method using correlation between adjacent LSP components is developed. Since LSP always satisfies an ordering property, this quantization method improves quantization efficiency.

There are vector quantization and scalar quantizations in quantizing the expected LSP coefficients. An 8 kbps QCELP voice coder uses scalar quantization. Since an 8 kbps QCELP voice coder scalar-quantizes each LSP component, relatively, many bits are allocated (40 bit) in comparison with voice coders with almost the same performance. Recently, the vector quantization method is employed for efficient quantization and many studies have been performed in the area.

In vector quantization, to quantize all vectors at once is impossible because the vector table is going to be too big and the time for a search is going to be enormous. To solve the problem, one large vector is split into several small vectors before quantization, and this method is called SVQ (split vector quantization). For example, in a $10^{th}$ order vector quantization using 20 bits quantizing the vector once requires a $10\times10^{20}$ vector table. If the vector is split into two fifth-order vectors and 10 bits are allocated for a vector, the size of the vector table is $5\times10^{10}\times2$.

The vector may be split into more small vectors for a smaller vector table size and it results in a small amount of memory and faster searching. However, correlation between vector values is not fully utilized in such cases and, therefore, performance is deteriorated. In the extreme, if a $10^{th}$ order vector is split into ten first order vectors, it becomes scalar quantization.

If SVQ is used and the LSP is directly quantized without expecting the LSP between 20 ms frames, a quantization performance of 24 bits may be obtained. However, since SVQ quantizes sub-vectors independently, correlation between the sub-vectors is not fully utilized, and therefore, optimization of the total vector is not accomplished.

Other than SVQ, there are several quantization methods such as multi-stage quantization, selective vector quantization, and linked split vector quantization. Multi-stage quantization divides quantization process into several stages. Selective vector quantization employs two tables and performs selective quantization. Linked split vector quantization reviews boundary values between sub-vectors and selects appropriate vector quantization tables.

SUMMARY OF THE INVENTION

A fast search method for LSP (Linear Spectrum Pair) quantization is provided. The fast search method in accordance with an embodiment of the present invention includes the following steps. A first step is obtaining a target vector and a code vector. The target vector and the code vector are converted for ordering property. A second step is generating a code book having the ordering property for sub-matrices by utilizing the target vector and the code vector. A third step is selecting a particular line for determining a search scope in the code books and sorting the code book in descending order with respect to component values of the particular line. A fourth step is determining the search scope by utilizing the ordering property of the target vector and the sorted code vectors. The fifth step is obtaining an error standard by utilizing the target vector and the code vector, and obtaining an optimal code vector by utilizing the error standard within the determined search scope.

Preferably, the first step includes following sub-steps. The first sub-step is obtaining a target vector for the mth sub-matrix, with an ordering property, by utilizing the LSP vector average value of the mth sub-matrix and the expectation value of the mth sub-matrix. The second sub-step is obtaining the lth code vector of the mth sub-matrix by utilizing the lth error code book of the mth sub-matrix and the lth DC component of the mth sub-matrix. The lth DC component of the mth sub-matrix has an ordering property. The third sub-step is obtaining an error standard by utilizing the target vector of the mth sub-matrix and the lth code vector of the mth sub-matrix and determining the code book index that minimizes the error standard.

Preferably, the error standard is obtained by applying the target vector of the mth sub-matrix and the lth code vector of the mth sub-matrix to the following equation 1 and equation 2.

[Equation 1]

$$\begin{aligned} E_{m,l} &= \sum_{i=0}^{3} [(r_{m,i} + L_{DC,m,i} - r'_{m,l,i} - L_{DC,m,i})w_{m,i}]^2 \\ &= \sum_{i=0}^{3} [\{(L_{m,i} - p_{m,i}) - (r'_{m,l,i} + L_{DC,m,i})\}w_{m,i}]^2 \\ &= \sum_{i=0}^{3} [(R_{m,i} - C_{m,l,i})w_{m,i}]^2 \\ &= \min(E_{m,l}, E_{m,l}^{(+)}) \end{aligned}$$

[Equation 2]

$$\begin{aligned} E_{m,l}^{(+)} &= \sum_{i=0}^{3} [(R_{m,i} - C_{m,l,i} - 2L_{DC})w_{m,i}]^2 \\ R_{m,i} &= L_{m,i} - P_{m,i}, \\ C_{m,l,i} &= r'_{m,l,i} + L_{DC_{m,i}} \end{aligned}$$

Preferably, the DC component is the LSP vector average value.

Preferably, the third step includes following sub-steps. The first sub-step is selecting a fourth line for the first code book, a third line for the second code book, the third code book, and the fourth code book, and fourth line for the fifth code book as a particular line. The second sub-step is sorting the whole code book in descending order with respect to the selected particular line.

Preferably, the fourth step obtains a starting point of the search scope by forward direction comparison and an ending point of the search scope by reverse direction comparison. The forward direction comparison compares the nth line component of the sorted code book with the (n+1)th line component of target vector. The reverse direction comparison compares the nth line component of the sorted code book with the (n−1)th line component of target vector.

Preferably, the process of obtaining the starting point obtains the smallest l value satisfying $R_{n+1}>C_{l,n}$, $R_{n+1}$ being n+lth target vector for the code book search of sub-matrix. $C_{l,n}$ is the nth code vector of the lth sub-matrix.

Preferably, the process of obtaining the starting point includes the following sub-steps. The first sub-step is finding i, satisfying $R_{n+1}>C_{i+64,n}$, by increasing i by 64. The second sub-step is for setting the variable j=i and finding j, satisfying $R_{n+1}>C_{j+16,n}$, by increasing j by 16. The third sub-step is setting variable k=j and finding k, satisfying $R_{n+1}>C_{k+4,n}$, by increasing k by 4. The fourth sub-step is setting variable m=k and finding m+1, satisfying $R_{n+1}>C_{m+1,n}$, by increasing m by 1. The fifth sub-step is setting the m+1 as the starting point.

Preferably, the process of obtaining the ending point obtains the smallest l value satisfying $R_{n-1}<C_{l,n}$. $R_{n-1}$ is the n−lth target vector for the code book search of sub-matrix. $C_{l,n}$ is the nth code vector of the lth sub-matrix.

Preferably, the process of obtaining the ending point includes the following sub-steps. The first sub-step is setting an initial value of i based upon the index number of each code book. The second sub-step is finding i, satisfying $R_{n-1}>C_{i-64,n}$, by decreasing i by 64. The third sub-step is setting variable j=i and finding j, satisfying $R_{n-1}>C_{j-16,n}$, by decreasing j by 16. The fourth sub-step is setting variable k=j and finding k, satisfying $R_{n-1}>C_{k-4,n}$, by decreasing k by 4. The fifth sub-step is setting variable m=k and finding m, satisfying $R_{n-1}>C_{m-1,n}$, by decreasing m by 1. The sixth sub-step is setting the m+1 as ending point l.

Preferably, the initial value of i is set 128 for setting the ending point of the first code book search, 256 for setting the ending point of the second, third, and fourth code book search and then to 64 for setting the ending point of the fifth code book search.

Preferably, the fourth step includes following sub-steps. The first sub-step is sorting the third code book in ascending order by subtracting DC component from the third code book, multiplying a result of the subtraction by −1, and adding the DC component, if a sign bit of third code book is 1. The third code book is sorted in descending order by the ordering property. The second sub-step is obtaining a starting point of the search scope by reverse comparison. The reverse comparison compares the nth line component of the sorted third code book with the (n−1)th line component of target vector. The third sub-step is obtaining an ending point of the search scope by a forward comparison. The forward comparison compares the nth line component of the sorted third code book with the (n+1)th line component of target vector.

Preferably, the process of obtaining the starting point obtains the smallest l value satisfying $R_{n+1}>C_{l,n}$, with $R_{n+1}$ being the n+1th target vector for a code book search of sub-matrix, and $C_{l,n}$ being the nth code vector of lth sub-matrix.

Preferably, the initial value of i is set at 128 for setting the starting point of the first code book search, 256 for setting the starting point of the second code book search, third code book search, and fourth code book search, and at 64 for setting the starting point of the fifth code book search.

A fast search method implemented in a computer system for LSP (Linear Spectrum Pair) quantization is provided. The fast search method for LSP (Linear Spectrum Pair) quantization in accordance with an embodiment of the present invention, includes following steps. The first step is obtaining a target vector and a code vector, the target vector and the code vector are converted for ordering property. The second step is generating a code book having the ordering property for sub-matrices by utilizing the target vector and the code vector. The third step is selecting a particular line for determining a search scope in the code book and sorting the code book in a regular order with respect to component values of the particular line. The fourth step is determining the search scope by utilizing the ordering property of the target vector and the sorted code vectors. And the fifth step is obtaining an error stand by utilizing the target vector and the code vector, and obtaining an optimal code vector by utilizing the error standard within the determined search scope.

Preferably, the LSP quantization is implemented by a predictive split VQ (Vector Quantization) method or a predictive split MQ (Matrix Quantization) method.

BRIEF DESCRIPTION OF THE DRAWINGS

The embodiments of the present invention will be explained with reference to the accompanying drawings, in which.

DETAILED DESCRIPTION OF THE INVENTION

Figure 1:
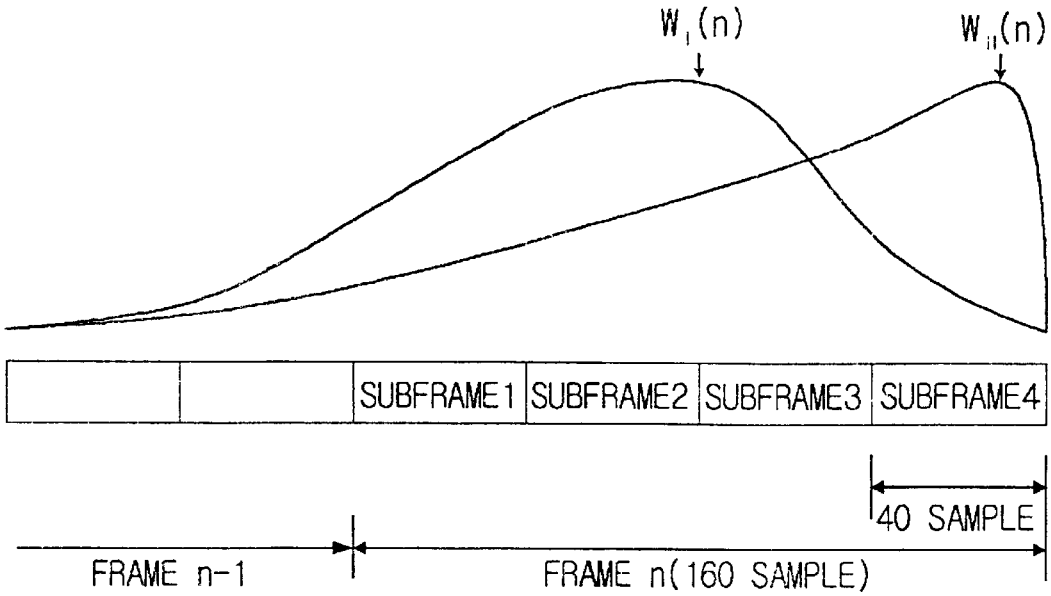
FIG. 1 is a diagram illustrating a linear predictive analysis window of an AMR (adaptive multirate) voice coder.

Generally, a representative voice coder for GSM (global system for mobile communication), 3 GPP (third generation partnership project), IMT 2000 (international mobile telecommunication) is the AMR (adaptive multirate) codec. The AMR codec has a voice coder of eight modes and, so called, state-of-the art coding technologies are integrated in the AMR codec. In an embodiment of the present invention, a fast search method for LSP quantization in PSMQ or PSVQ is provided.

When quantizing LSP coefficients, AMR voice coders quantize error signals, with a difference between the LSP coefficient vector in which the DC component is removed, and in which the vector is expected by MA estimators. Therefore AMR voice coders are not able to utilize an ordering property.

In an embodiment of the present invention, a MA estimator is used and a target vector and an error code book, with ordering property, are formed by adding the DC component to target vector and the error code book. Then, a particular line used for a search scope decision is selected in a code book with an ordering property and whole code book is sorted in descending order on the basis of components of the particular line. Component values sorted in each code book are compared with component values around related lines in the target vector, and then an error criterion ($E_{m,\ l}$) for vectors satisfying ordering property is obtained. The search scope of a code book is obtained by comparing the forward direction and reverse direction. The amount of calculation required for the code book search is reduced without distorting the spectrum in an embodiment of the present invention.

An AMR codec includes eight source codecs and a 12.2 kbps mode is used for the GSM EFR (global system for mobile communication enhancement full rate) standard. In GSM EFR, using two different asymmetric windows, two sets of LPC coefficients are transmitted in every transmission frame (20 msec) by performing two linear predictions in each frame. The remaining source codec transmits a set of LPC coefficients by performing one linear prediction for each frame.

Usually, the LPC coefficient is converted into a LSP (linear spectrum pair) and then quantized. The LSP is mathematically equivalent to a LPC coefficient and has good quantization characteristics. Also, it is easy to examine the stability of a composite filter, regarding the LSP. Since the LSP has uniform spectrum stability, spectrum distortion is minimized in transmission. In addition, the LSP has good characteristics in linear interpolation.

Important characteristics of LSP coefficients are as follows.

First, composite filters are stable only if LSP coefficients satisfy following condition.

$$0<w_1<w_2<\ldots<w_p<\pi$$

Second, LSP coefficients represent format frequency and format bandwidth of voice. Format frequency is a central area in which a particular frequency is dominant when a voice signal is converted into frequency domain. The dominant area is called format bandwidth. That is, as LSP coefficients locate closely, sharp format bandwidth is generated.

Third, LSP coefficients, interpolated, satisfy ordering property.

Fourth, since dynamic range of the LSP is small, LSP is good for quantization.

In order to quantize LSP coefficients, SMQ (split matrix quantization) is used in 12.2 kbps. That is, two residual LSF (line spectral frequencies) vectors are quantized together in 12.2 kbps and LSP coefficients are quantized by SVQ (split vector quantization) in other modes.

In the present invention, a fast algorithm for efficient LSP coefficient quantization is proposed.

First, a LSP code book search method applied to predictive SMQ is reviewed.

FIG. 1 is a diagram illustrating a linear predictive analysis window of an AMR (adaptive multirate) voice coder. As shown in FIG. 1, a LP analysis in 12.2 kbps uses two different asymmetric windows and the LP analysis is performed twice for each window.

The first window, $W_1(n)$ has a priority on the second sub-frame (subframe2) and is composed of two Hamming windows. In other words, the first window, $W_1(n)$, is described in equation 1.

$$W_I(n) = 0.54 - 0.46\cos\left(\frac{\pi n}{L_1^{(I)} - 1}\right),\ n = 0, \ldots, L_1^{(I)} - 1 \quad \text{[Equation 1]}$$
$$= 0.54 + 0.46\cos\left(\frac{\pi(n - L_1^{(I)})}{L_2^{(I)} - 1}\right),\ n = L_1^{(I)}, \ldots, L_1^{(I)} + L_2^{(I)} - 1$$

In equation 1, $L_1^{(I)}$ is 160 and $L_2^{(I)}$ is 80.

The second window, $W_{II}(n)$ has a priority on fourth sub-frame (subframes) and includes two parts. The first part is the half of the hamming window and the second part is a quarter of the cosine function period. The second window is described in equation 2.

$$W_{II}(n) = 0.54 - 0.46\cos\left(\frac{\pi n}{2L_1^{(II)} - 1}\right),\ n = 0, \ldots, L_1^{(II)} - 1 \quad \text{[Equation 2]}$$
$$= \cos\left(\frac{2\pi(n - L_1^{(II)})}{4L_2^{(II)} - 1}\right),\ n = L_1^{(II)}, \ldots, L_1^{(II)} + L_2^{(II)} - 1$$

In equation 2, $L_1^{(II)}$ is 232 and $L_1^{(II)}$ is 8.

A linear predictive analysis is performed twice in same voice sample frame. An analysis window is formed by adding 80 samples of previous voice frames to 160 samples of the current voice frame. Samples of future frames are not used. Two sets of the LP in each frame are quantized in 12.2 kbps mode, in frequency domain, and is described in equation 3.

$$f_i = \frac{f_s}{2\pi}\arccos(q_i),\ i = 1, \ldots, 10 \quad \text{[Equation 3]}$$

$f_i$: LSF (linear spectral frequencies) $0 \leqq f_i \leqq 4000$ $f_s$: sampling frequency=8000 hz A first order MA (moving average) estimator is used and two residual LSF vectors are quantized with a SMQ (split matrix quantization) method.

Figure 2:
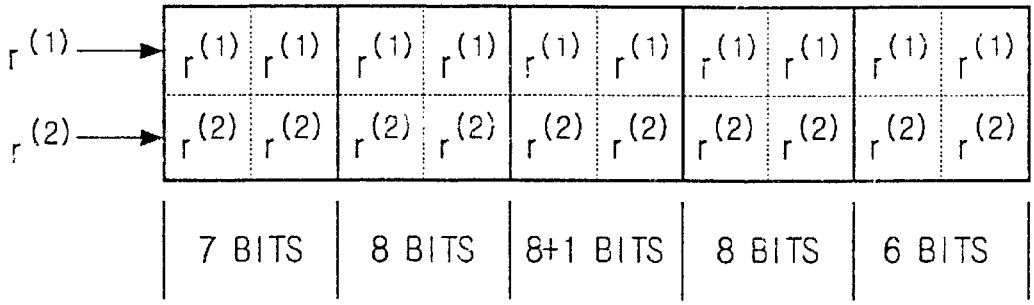
FIG. 2 is a diagram illustrating a surplus linear spectrum frequency vector of split matrix quantization used in 12.2 kbps.

FIG. 2 is a diagram illustrating the surplus linear spectrum frequency vector of the split matrix quantization used in 12.2 kbps. Two LSF residual vectors, $r^{(1)}(n)$ and $r^{(2)}(n)$, are quantized together by the linear matrix quantization method. Two LSF residual vectors, $r^{(1)}(n)$ and $r^{(2)}(n)$, are divided into five sub-matrices and one sub-matrix, including 2×2 components. The five sub-matrices are quantized by 7 bit, 8 bit, 8+1 bit, 8 bit and 6 bit, respectively. The code book for third sub-matrix is composed of 256 code vectors. 8 bits are allocated for the index and 1 bit is allocated for sign bit. In sum, 9 bits are used for finding the optimal code vector.

Figure 3:
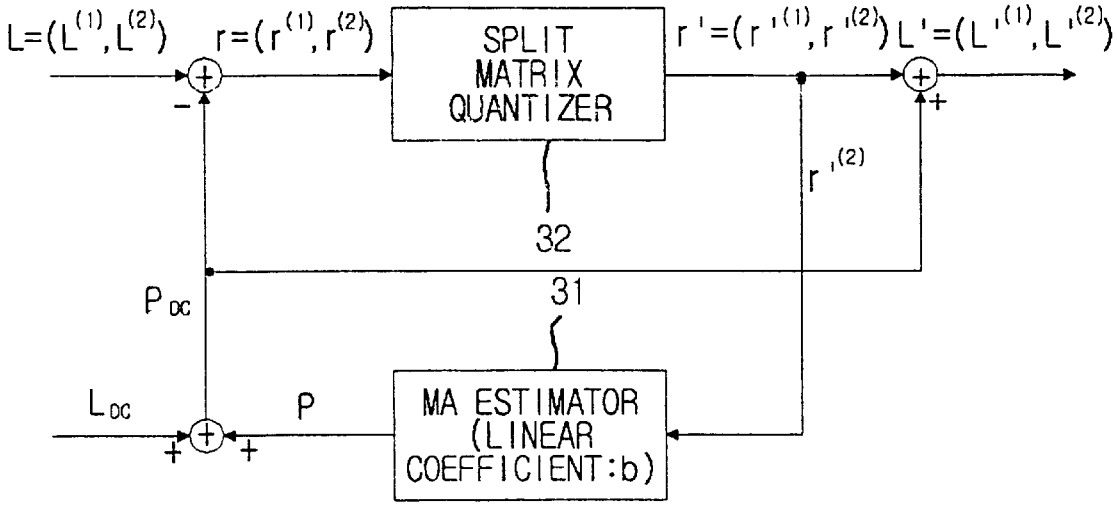
FIG. 3 is a block diagram illustrating the structure of PSMQ (predictive split matrix quantization) of an AMR voice coder.

FIG. 3 is a block diagram illustrating the structure of PSMQ (predictive split matrix quantization) of the AMR voice coder. The MA estimator 31 is a first order MA estimator. The LPC coefficients are obtained from the first window, $W_I(n)$, and the second window, $W_{II}(n)$. The coefficients obtained from the first window are converted into LSP coefficients of vector $L^{(1)}$. The coefficients obtained from the second window are converted into LSP coefficients of vector $L^{(2)}$. $L_{DC}$ is an average vector that is the DC component of the LSP coefficients. $P_{DC}$ is obtained by adding $L_{DC}$ to the expectation vector P. The P vector is obtained through a MA estimator 31[?] by applying the first order linear coefficient b (b=0.65) to the second error vector $r'^{(2)}$, of the quantized previous frame. Error vectors $r^{(1)}$ and $r^{(2)}$ are obtained by subtracting $P_{DC}$ from $L^{(1)}$ and $L^{(2)}$, respectively. Error vectors $r^{(1)}$ and $r^{(2)}$ are divided into five 2×2 sub matrices ($r_m=(r^{(1)}, r^{(2)})$). Equation 4 describes these procedures mathematically.

$$P_{DC}(n)=L_{DC}+br'^{(2)}$$
$$r^{(1)}=L^{(1)}-P_{DC}$$
$$r^{(2)}=L^{(2)}-P_{DC} \quad \text{[Equation 4]}$$

As stated above, five sub-matrices are quantized by 7 bits, 8 bits, 9 bits, 8 bits and 6 bits, respectively. The third sub-matrix includes one bit sign, bit as shown in equation 5.

$$r_m=(r^{(1)},r^{(2)})_m=\{r_{1+2m}^{(1)},r_{2+2m}^{(1)},r_{1+2m}^{(2)},r_{2+2m}^{(2)}\},\ m=0,1,2,3,4 \quad \text{[Equation 5]}$$

m: order of sub-matrix n: current frame

The optimal code of each sub-matrix is selected as an error standard value ($E_{m,l}$) is minimized. Equation 6 and equation 7 describes the procedure.

$$E_{m,l} = \sum_{i=0}^{3}[(r_{m,i} - r'_{m,l,i})w_{m,i}]^2, \quad \text{[Equation 6]}$$
$$\text{when } m = 0,\ 0 \le 1 \le 127$$
$$m = 1,\ 3\ 0 \le 1 \le 255$$
$$m = 4,\ 0 \le 1 \le 63$$
$$= \min(E_{m,l}, E_{m,l}^{(+)}),$$
$$\text{when } m = 2,\ 0 \le 1 \le 255$$

$$E_{m,l}^{(+)} = \sum_{i=0}^{3}[(r_{m,i} + r'_{m,l,i})w_{m,i}]^2 \quad \text{[Equation 7]}$$

$r_m$.: target vector for code book search regarding mth sub-matrix $r'_{m,l}$: lth code vector of mth sub-matrix $w_m$: weighting matrix for mth sub-matrix, obtained non-quantized LSP vector L i: ith component of sub-matrix Using the equations, the code book index 1 minimizing error standard value ($E_{m,l}$) is obtained and transmitted across a channel.

Index k of third sub-matrix (m=2) has a sign value of zero when $E_{m,l}^{(-)}$ is selected as the minimum value, and has sign value of one when $E_{ml}^{(+)}$ is selected as a minimum value. Equation 8 describes this procedure mathematically.

$$k=2l+\text{sign} \quad \text{[Equation 8]}$$

Now, the LSP coefficients are obtained. When the LSP coefficients are quantized, most of time taken for quantization is spent on searching for optimal code vectors from the five sub-matrices.

Therefore, a fast search method, in accordance with an embodiment of the present invention, reduces amount of search calculation by decreasing the scope of code vectors for searches. This method utilizes an ordering property of LSP coefficients. Now, a fast search method, in accordance with an embodiment of the present invention, is briefly introduced.

First, a code book is generated by adding five sub-matrices to average vector $L_{DC}$. Next, the code book is sorted in descending order by a component value in the code book. Since an optimal code vector that minimizes $E_{m,l}$, regarding five sub-matrices, has a similar value to the target vector, the optimal code vector may be said to have an ordering property. Under this assumption, particular components of values sorted in descending order within the code book are compared with values of adjacent lines. Next, $E_{m,l}$ values are calculated only when code vectors satisfy the ordering property. Other code vectors not satisfying ordering property are not applied to calculating $E_{m,l}$ values.

Like this, when each code book is searched, it is advantageous to decrease the amount of calculation by reducing search scope within the help of the ordering property of the LSP vector.

Now, a procedure for applying the fast search method to a 12.2 kbps mode is described. First, target vector $r_m$ and the related code book don't have ordering properties since they are error vectors obtained by subtracting $L_{DC}$ and $P_m$. Therefore, equation 6 and equation 7 are converted into equation 9 and equation 10, and then the target vector, with ordering property, is obtained.

$$E_{m,l} = \sum_{i=0}^{3} [(r_{m,i} + L_{DC,m,i} - r'_{m,l,i} - L_{DC,m,i})w_{m,i}]^2 \quad \text{[Equation 9]}$$

$$= \sum_{i=0}^{3} [\{(L_{m,i} - p_{m,i}) - (r'_{m,l,i} + L_{DC,m,i})\}w_{m,i}]^2$$

$$= \sum_{i=0}^{3} [(R_{m,i} - C_{m,l,i})w_{m,i}]^2,$$

when $m = 0,\ 0 \le 1 \le 127$ $m = 1,\ 3\ 0 \le 1 \le 255$ $m = 4,\ 0 \le 1 \le 63$ $= \min(E_{m,l}, E^{(+)}_{m,l}),$ when $m = 2,\ 0 \le 1 \le 255$ $$E^{(+)}_{m,l} = \sum_{i=0}^{3} [(R_{m,i} + C_{m,l,i} - 2L_{DC})w_{m,i}]^2 \quad \text{[Equation 10]}$$

$$R_{m,i} = L_{m,i} - P_{m,i},$$

$$C_{m,l,i} = r'_{m,l,i} + L_{DC_{-m,i}}$$

In equation 9 and equation 10, $E_{m,l}$ may be obtained from $(L_m - P_m)$ and $(r'_{m,l+LDC})$. If $R_m$ is $(L_m - P_m)$, $L_{DC}$ is not removed and $P_m$ is expected on the basis of error value, which means a small variance. $R_m$ becomes a target vector of the code book search with an ordering property. $(r'_{m,l} + L_{DC})$ is $C_{m,l}$, $C_{m,l}$ has ordering property since this value results from adding existing error code book $r'_{m,l}$ to $L_{DC}$, that has ordering property. Also, since $r'_{m,l}$ and $L_{DC}$ are all fixed values, $C_{m,l}$ may be pre-calculated and replace existing the code book.

Likewise, $E_{m,l}$ is obtained from $R_m$ and $C_{m,l}$ and the code book index I that minimizes $E_{m,l}$ is obtained and transmitted through the channel.

Figure 5:
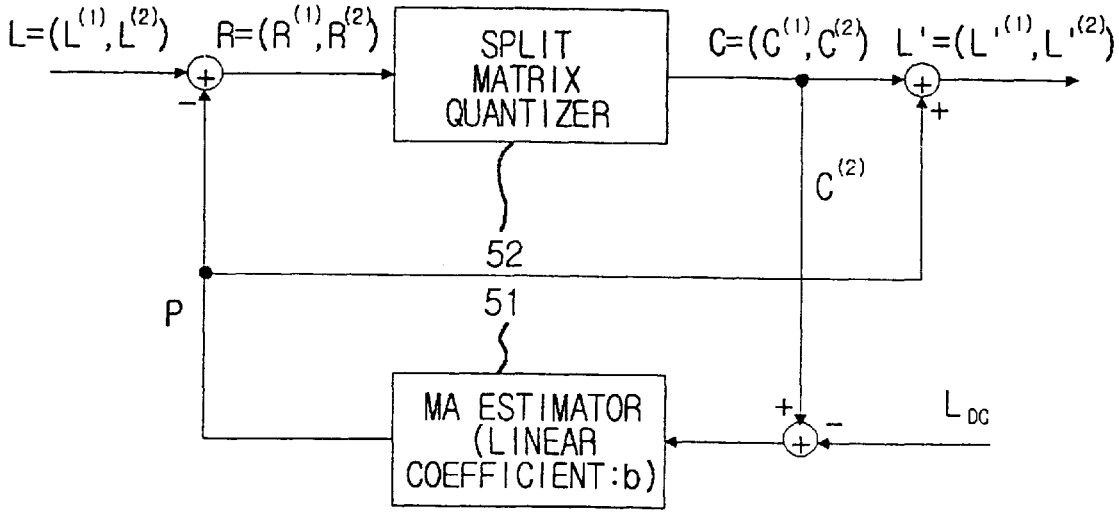
FIG. 5 is a block diagram illustrating the structure of PSMQ (predictive split matrix quantization), in accordance with an embodiment of the present invention.

FIG. 5 is a block diagram illustrating the structure of a PSMQ (predictive split matrix quantization), in accordance with an embodiment of the present invention.

Since the structure shown in FIG. 5 is designed to utilize the result of equation 9 and equation 10, basically it is same as the structure shown in FIG. 3. However, it is different in that a procedure of $L_{DC}$ subtraction is omitted and the code book regarding each sub-frame is replaced by new code books. $L_{DC}$ is already added to the new code books. After this procedure, target vectors and related code books all have ordering properties.

Figure 7:
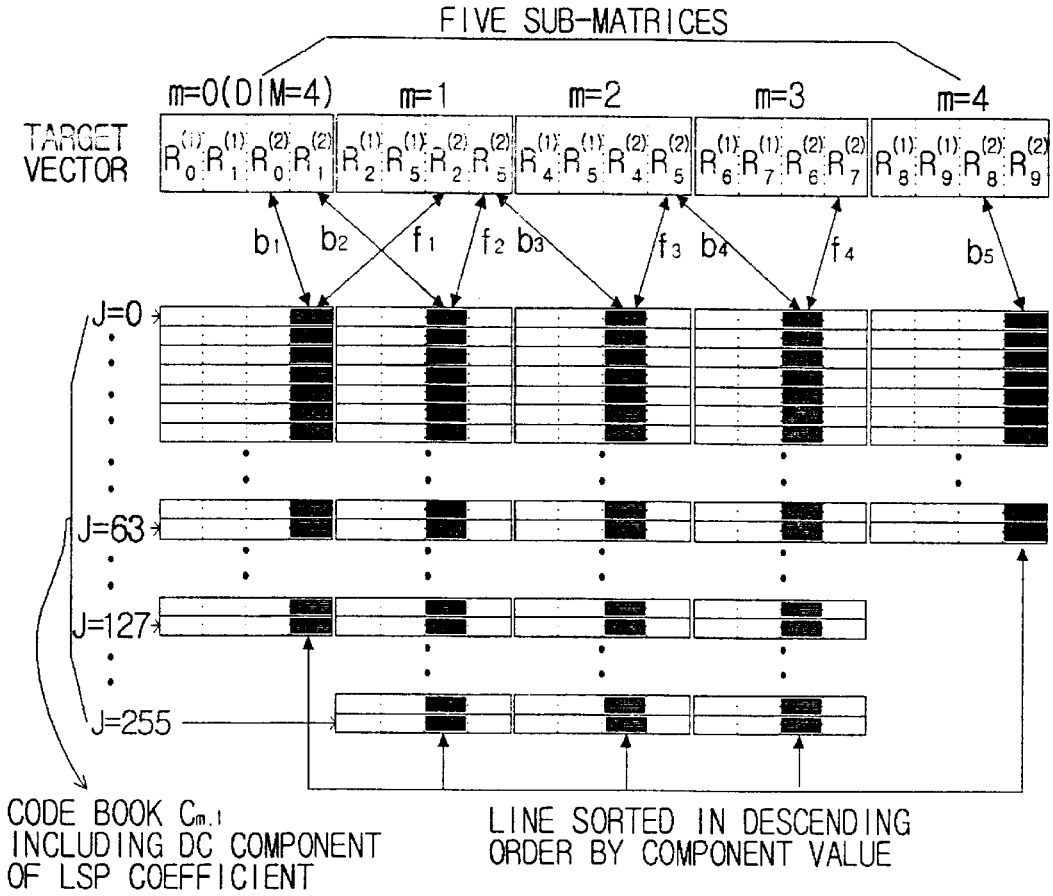
FIG. 7 is a block diagram illustrating a forward comparison method and a reverse direction comparison method when a search code vector is selected in a SMQ (split matrix quantization)

FIG. 7 is a block diagram illustrating a forward comparison method and a reverse direction comparison method when a search code vector is selected in SMQ (split matrix quantization). That is, regarding the five code books of the 2×2 matrix, the code vector in first code book is sorted in descending order with respect to the components of the fourth line. The code vector in the second code book, the third code book, and the fourth code book is sorted in descending order with respect to components of the third line. The code vector in the fifth code book is sorted in descending order with respect to components of the fourth line. Since the sorted code books and the target vector includes the DC component, they have ordering property. Selecting a particular line in each code book is performed tentatively.

The scope of the code book search is determined by the concept in which a particular line components of the code book are compared with particular line components of target vectors and code vectors violating ordering property are excluded. This procedure uses equation 11 and equation 12.

$$R_{n+1}^{(2)} > C_{l,n}^{(2)},\ \text{when } m=0, n=1,\ 0 \leqq l \leqq 127 \quad \text{[Equation 11]}$$

when m=1,2,3 n =2m, 0≦1≦255

$$R_{n-1}^{(2)} > C_{l,n}^{(2)},\ \text{when } m=0, n=1,\ 0 \leqq l \leqq 127$$

when m=1,2,3 n=2m, 0≦1≦255

$$R_{n-1}^{(2)} < C_{l,n}^{(2)},\ \text{when } m=4, n=9,\ 0 \leqq l \leqq 63 \quad \text{[Equation 12]}$$

As shown in equation 11, it is called a forward direction comparison if the nth line component of a code book is compared with the (n+1)th line component of the target vector. As shown in equation 12, it is called reverse a direction comparison if the nth line component of a code book is compared with (n−1)th line component of the target vector.

FIG. 7 is a diagram to illustrate the fast search method, in accordance with an embodiment of the present invention. In FIG. 7, $f_1$, $f_2$, $f_3$, $f_4$, and $f_5$ represent component values in code books used for forward direction comparison and reverse direction comparison. In FIG. 7, $b_1$, $b_2$, $b_3$, $b_4$, and $b_5$ represent component values in target vector, used for forward direction comparison and reverse direction comparison. Since each code book is sorted in descending order with respect to a particular line in the sub-matrix, the starting point of search scope is obtained by forward direction comparison and the ending point of a search scope is obtained by reverse direction comparison. Likewise, the overall search scope satisfying an ordering property is obtained. Once the overall search scope is determined, a code book within the scope is searched and $E_{m,L}$ is achieved.

Figure 9:
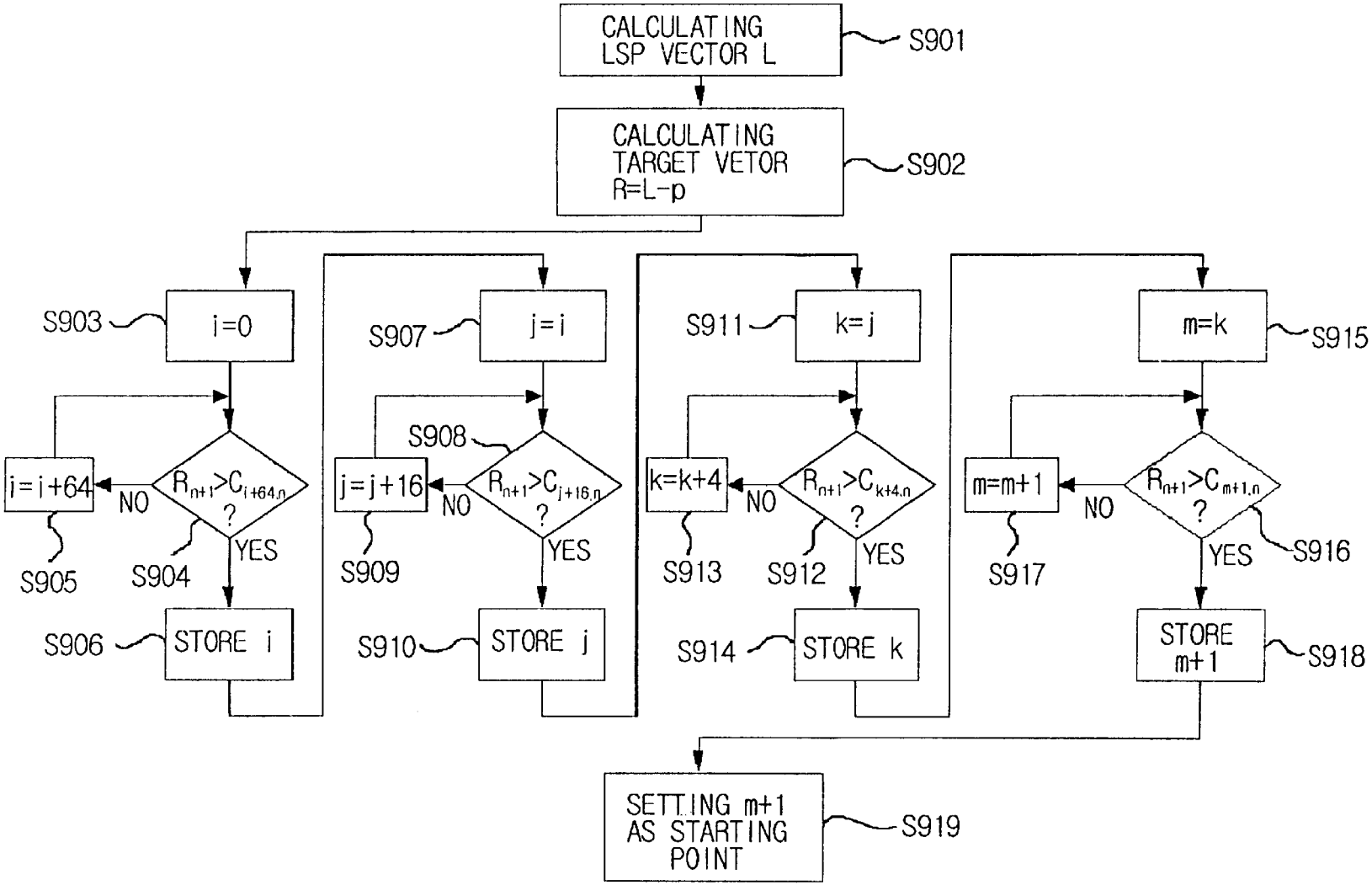
FIG. 9 is a flow diagram illustrating a forward direction comparison method for obtaining a starting point of a code book search.

FIG. 9 is a flow diagram illustrating a forward direction comparison method for obtaining a starting point of code book search. FIG. 10 is a flow diagram illustrating a reverse direction comparison method for obtaining an ending point of code book search in SMQ (split matrix quantization).

In the present invention, a starting point and an ending point for code book searches are found by utilizing the ordering property of the LSP, and the code book search is performed within the scope. The smallest L value satisfying $R_{n+1} > C_{l,n}$ is set as a starting point of the code book search. Once the l value is determined like this, the code book search regarding each sub-matrices may start after this l value. Since it is not efficient to increase the l value from $C_{l,n}$ to $C_{last,\ n}$ by 1, l value is increased by 64, 16, 4, 1 units to find a value satisfying $R_{n+1} > C_{l,n}$. The increment of the l value may be determined differently.

As shown in FIG. 9, the L and DC components of the LSP vector are calculated at step S901 and then the target vector is calculated at step S902. Since a forward direction comparison is not performed for the fifth code book, the starting point is always 0. That is, variable i is set as i=0 at step S903.

At step S904, $R_{n+1} > C_{i+64,.n}$ is determined. If result of the comparison is negative, variable i is replaced by i+64 at step S905 and step 904 is performed again. However, if the result of the comparison is positive, the value of variable i is stored at step S905 and step S907 is performed.

Later, the value of variable j is replaced by the value of variable i at step S907. At step S908, $R_{n+1}>C_{j+16,n}$ is determined. If the result of the comparison is negative, variable j is replaced by j+64 at step S909 and step 908 is performed again. However, if the result of the comparison is positive, the value of variable j is stored at step S910 and step S911 is performed.

Later, the value of variable k is replaced by the value of variable j at step S911. At step S912, $R_{n+1}>C_{k+4,n}$ is determined. If the result of the comparison is negative, variable k is replaced by k+4 at step S913 and step 912 is performed again. However, if the result of the comparison is positive, the value of variable k is stored at step S914 and step S915 is performed.

Later, the value of variable m is replaced by the value of variable j at step S915. At step S916, $R_{n+1}>C_{m+1,n}$ is determined. If the result of the comparison is negative, variable m is replaced by m+1 at step S918 and step 917 is performed again. However, if the result of the comparison is positive, the value of variable m+1 is stored at step S919 and the stored m+1 value is set as starting point for the search scope at step S920.

Figure 10A:
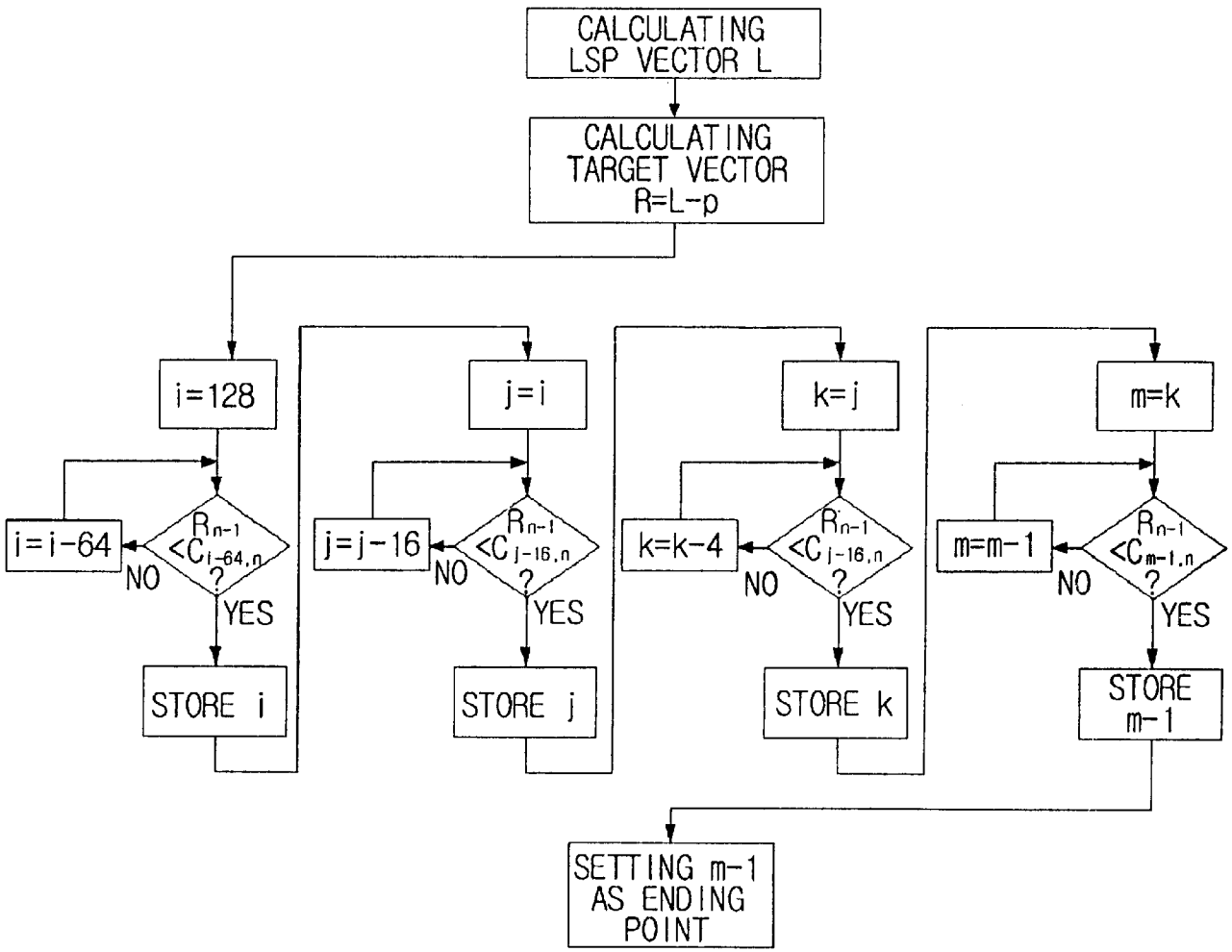
FIG. 10A, FIG. 10B and FIG. 10C are flow diagrams illustrating a reverse direction comparison method for obtaining an ending point of code book search in a SMQ (split matrix quantization)
Figure 10B:
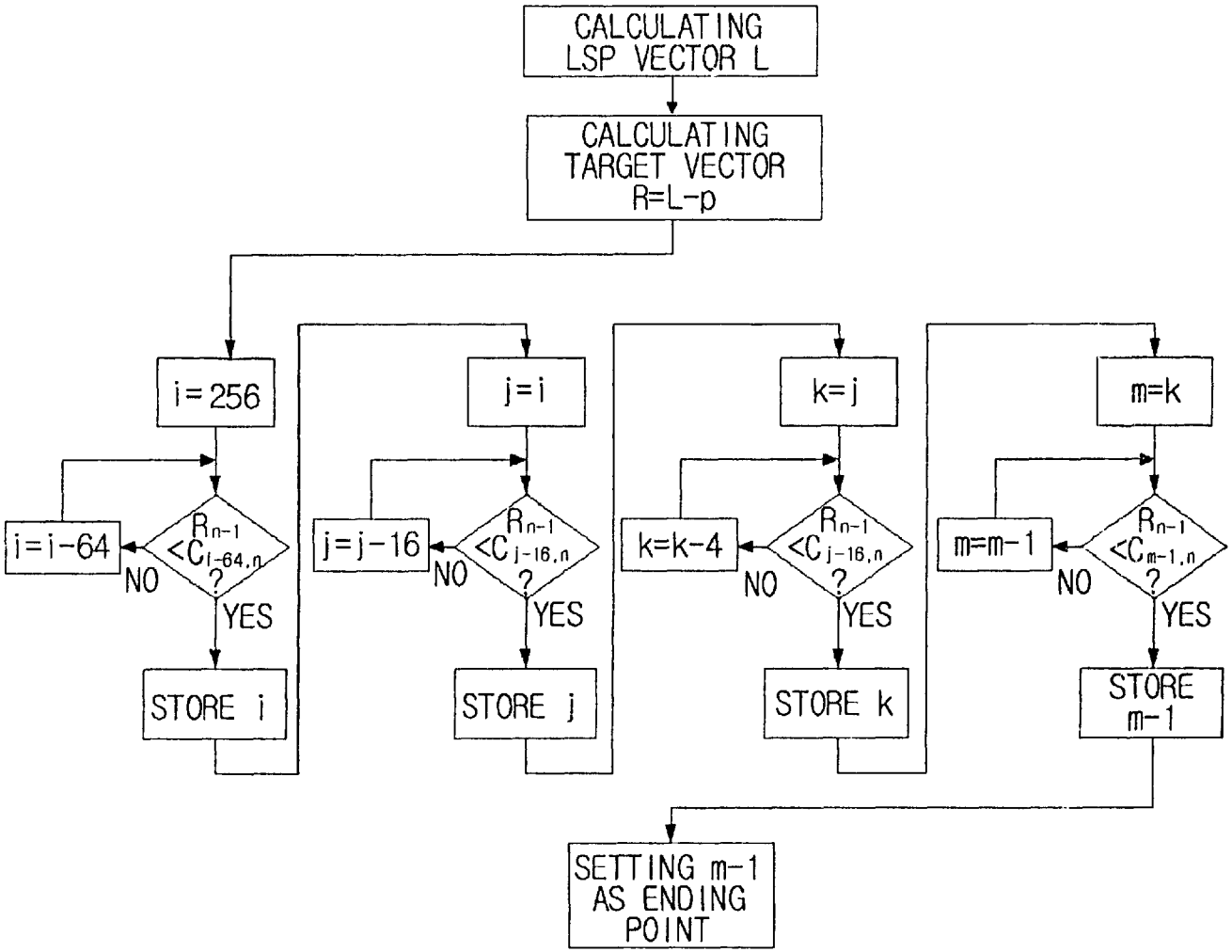
Figure 10C:
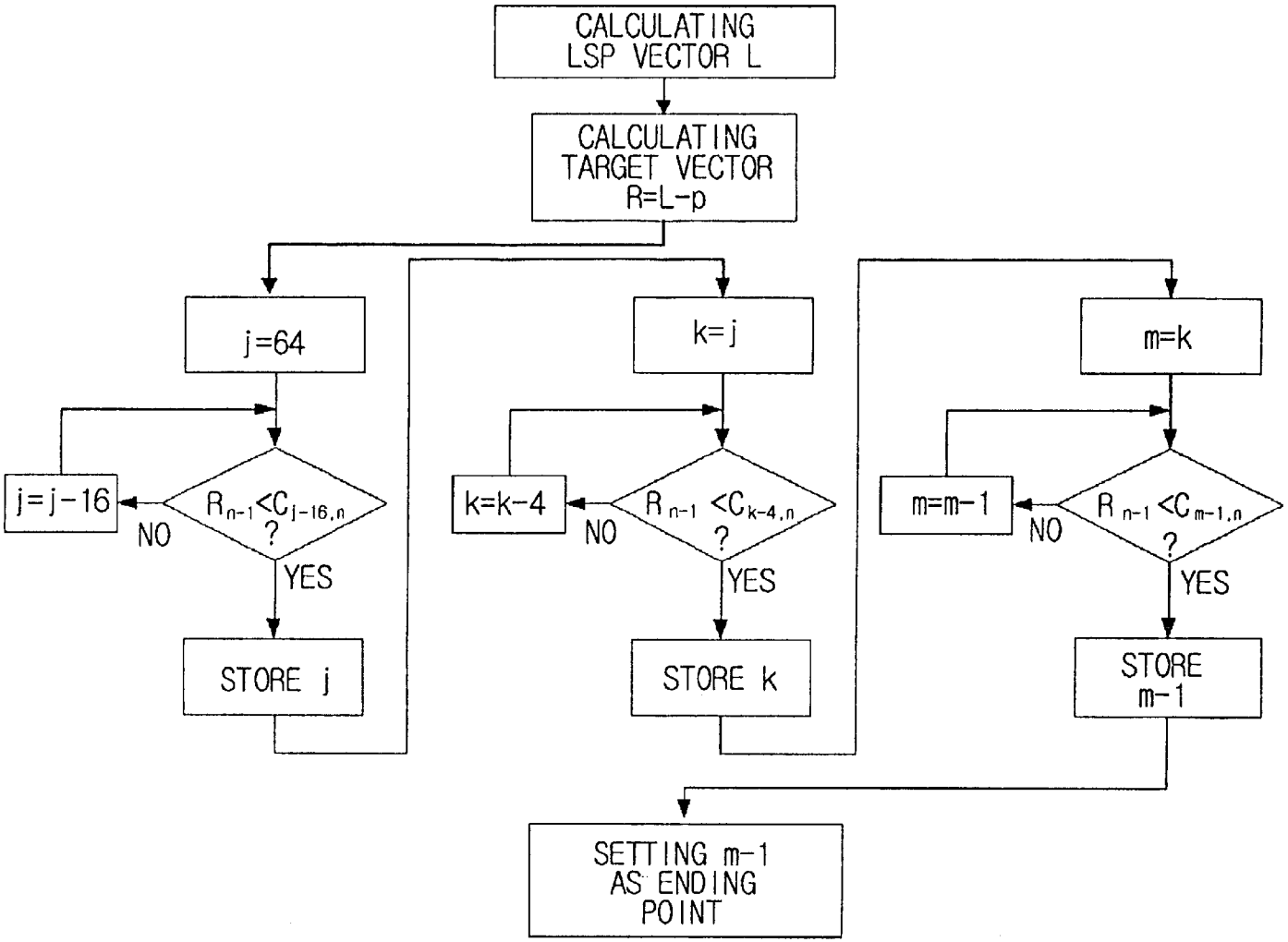

FIG. 10A, FIG. 10B and FIG. 10C are flow diagrams illustrating a reverse direction comparison method for obtaining an ending point of the code book search in SMQ (split matrix quantization). That is, the ending point of the search scope is determined by reverse direction comparison and it is the biggest l value satisfying $R_{n-1}<C_{l,n}$. Here, n is 1 for first code book, 2 for second code book, 3 for third code book, 4 for fourth code book and 5 for fifth code book.

Like the process of obtaining the starting point, it is not efficient to perform sequential search from $C_{last,n}$ to $C_{l,n}$. Instead, l value is decreased like 64, 16, 4, and 1 to find an optimal value.

FIG. 10A illustrates finding an ending point of the search scope regarding the first code book. The first L and DC components of the LSP vector are calculated, and then the target vector R is calculated. Since the number of the first code book index is 127, the initial value of i is set as i=128.

Once the initial value is found, the value of i is decreased by 64 until i satisfying $R_{n-1}<C_{i-64,n}$ is found. If i is found, variable j is set as j=i and then the value of variable j is decreased by 16 until j satisfying $R_{n-1}<C_{j-16,n}$ is found. If j is found, variable k is set as k=j, and then the value of variable k is decreased by 4 until k satisfying $R_{n-1}<C_{k-4,n}$ is found. If k is found, variable m is set as m=k and then value of variable m is decreased by 1 until m satisfying $R_{n-1}<C_{m-1,n}$ is found. Once m is found, the ending point l is set as l=m−1.

FIG. 10B illustrates finding an ending point of the search scope regarding the second code book, the third code book, and the fourth code book. The first L and DC components of the LSP vectors are calculated, and then the target vector R is calculated by the method stated above.

Since the number of index in second, third, and fourth code book is 246 and 256 is bigger than 24 and a multiple of 64, the initial value of i is set as i=256.

Once the initial value is found, value of i is decreased by 64 until i satisfying $R_{n-1}<C_{i-64,n}$ is found. If i is found, variable j is set as j=i and then the value of variable j is decreased by 16 until j satisfying $R_{n-1}<C_{j-16,n}$ is found. If j is found, variable k is set as k=j and then the value of variable k is decreased by 4 until k satisfying $R_{n-1}<C_{k-4,n}$ is found. If k is found, variable m is set as m=k and then the value of variable m is decreased by 1 until m satisfying $R_{n-1}<C_{m-1,n}$ is found. Once m is found, the ending point l is set as l=m−1.

FIG. 10C illustrates finding the ending point of the search scope regarding the fifth code book. The first L and DC components of LSP vector is calculated and then target vector R is calculated by the method stated above. Since the number of first code book index is 64, initial value of i is set as i=64.

Once the initial value is found, variable j is decreased by 16 until j satisfying $R_{n-1}<C_{j-16,n}$ is found. If j is found, variable k is set as k=j and then the value of variable k is decreased by 4 until k satisfying $R_{n-1}<C_{k-4,n}$ is found. If k is found, variable m is set as m=k and then the value of variable m is decreased by 1 until m satisfying $R_{n-1}<C_{m-1,n}$ is found. Once m is found, the ending point l is set as l=m−1.

In the case of the third code book, choosing the smaller between $E_{m,l}$ obtained by subtraction of the code vector from the target vector, and $E_{m,l}^{(+)}$, obtained by addition of the code vector to the target vector, makes an effect that the actual 256 code book is utilized as 512 code book. Here, if the case is subtraction, sign becomes 0. If the case is addition, sign becomes 1. There are two cases for the third sub-matrix, one for zero sign bit and the other for one sign bit. If the sign bit is zero, the starting point is obtained on the basis of FIG. 9 and ending point is obtained on the basis of FIG. 10B. However, if the sign bit is one, the starting point and ending point are obtained in a different way.

Figure 12:
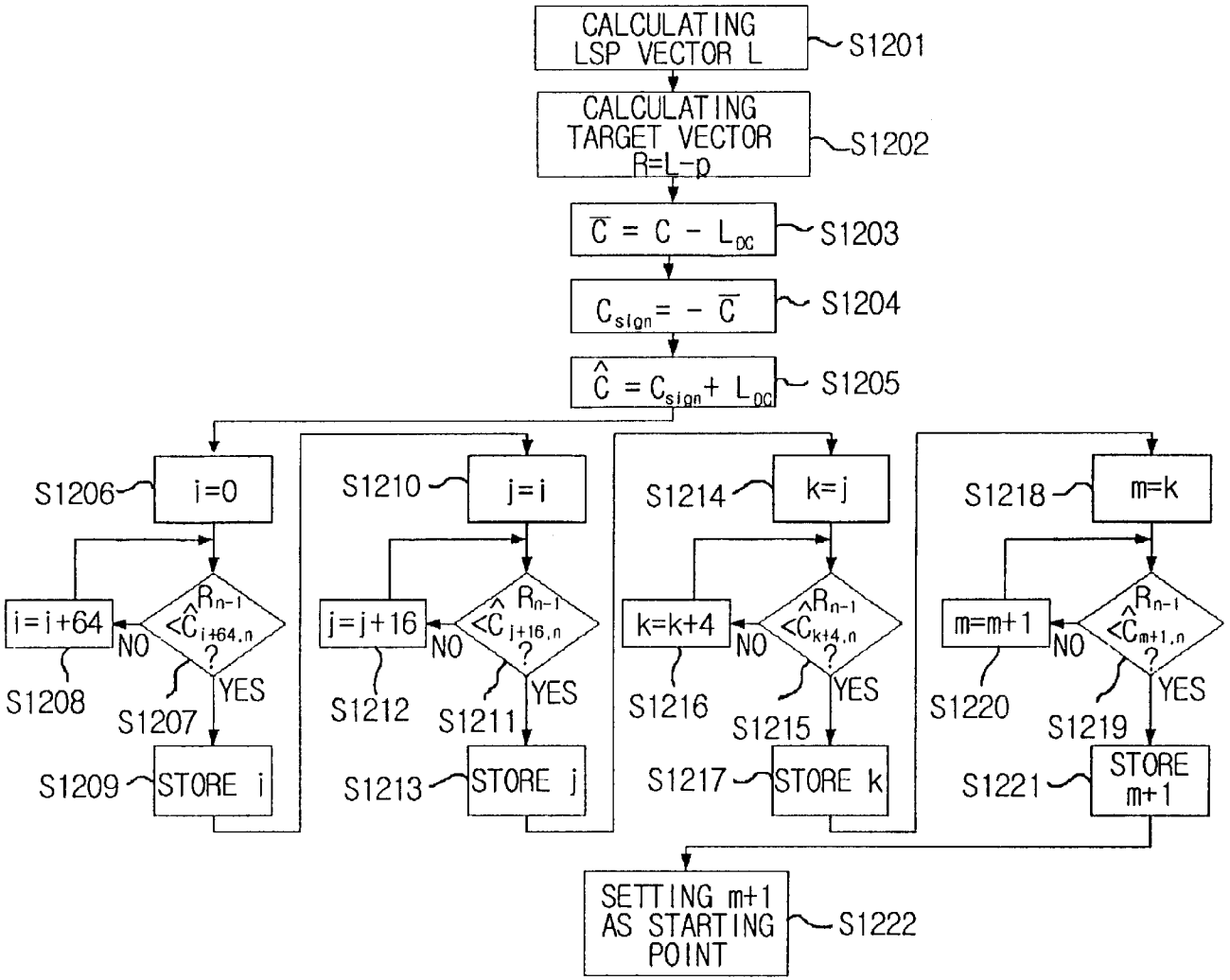
FIG. 12 is a flow diagram illustrating a method for finding the starting point when the sign value is 1 in the third code book, searching in a SMQ (split matrix quantization)
Figure 13:
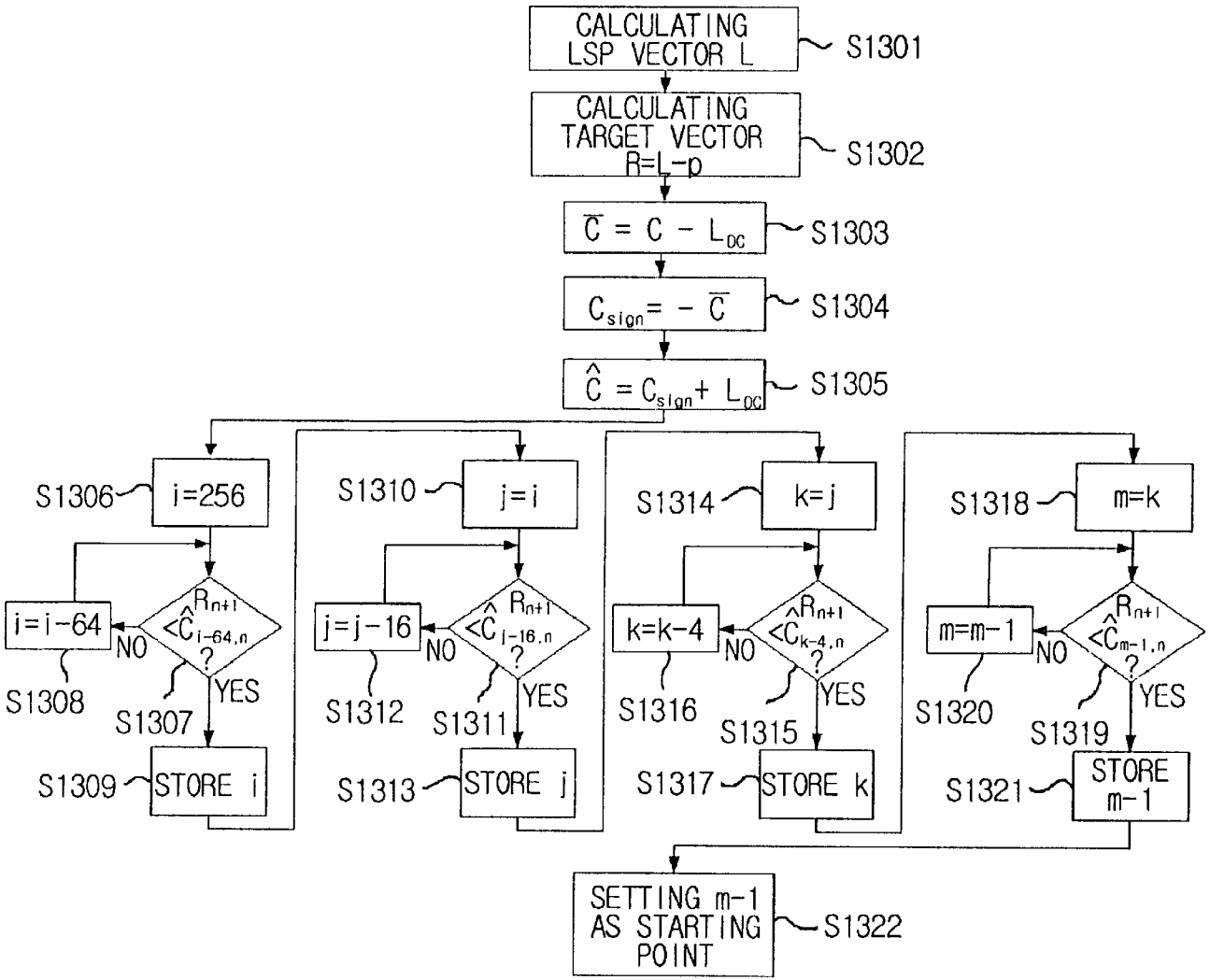
FIG. 13 is a flow diagram illustrating a method for finding the starting point when the sign value is 1 in the third code book, searching in a SVQ (split vector quantization).

FIG. 12 is a flow diagram illustrating a method for finding the starting point when sign value is 1 in the third code book, searching in SMQ (split matrix quantization). FIG. 13 is a flow diagram illustrating a method for finding the starting point when sign value is 1 in the third code book, searching in SVQ (split vector quantization).

As shown in FIG. 12, the L and DC components of the LSP vector are calculated at step S1201 and then the target vector R is calculated at step S1202. Then, the DC component is subtracted from $C_{ml}$ at step S1203. The result of the subtraction is multiplied by −1 at step 1204 and then again the DC component is added at step S1205. By this procedure, the code book that was sorted in descending order is now sorted in ascending order. The starting point of the code book sorted in ascending order is obtained by a reverse direction comparison.

That is, once the initial value is set as i=0 at step S1206, the value of i is increased by 64 until i satisfying $R_{n-1}<\hat{C}_{i+64,n}$ is found at step S1207, S1208, and S1209. If i is found, variable j is set as j=i at step S1210 and then the value of variable j is increased by 16 until j satisfying $R_{n-1}<\hat{C}_{j+16,n}$ is found at step S1211, S1212, and S1213. If j is found, variable k is set as k=j at step S1214 and then the value of variable k is increased by 4 until k satisfying $R_{n-1}<\hat{C}_{k+4,n}$ is found at step S1215, S1216, and S1217. If k is found, variable m is set as m=k at step S1218 and then the value of variable m is increased by 1 until m satisfying $R_{n-1}<\hat{C}_{m+4,n}$ is found at step S1219, S1220, and S1221. Once m is found, the starting point is set m+1 at step S1222.

As shown in FIG. 13, the L and DC components of LSP vector are calculated at step S1301 and then the target vector R is calculated at step S1302. Then, the DC component is subtracted from $C_{m,l}$ at step S1303. The result of the subtraction is multiplied by −1 at step 1304, and, then again, the DC component is added at step S1305. By this procedure, the code book that was sorted in descending order now is sorted in ascending order. The starting point of the code book, sorted in ascending order, is obtained by a forward direction comparison.

That is, once the initial value is set as i=256 at step S1306, value of i is decreased by 64 until i satisfying $R_{n+1}>\hat{C}_{i-64,n}$ is found at step S1307, S1308, and S1309. If i is found, variable j is set as j=i at step S1310 and then the value of variable j is decreased by 16 until j satisfying $R_{n+1}>\hat{C}_{j-16,n}$ is found at step S1311, S1312, and S1313. If j is found, variable k is set as k=j at step S1314 and then the value of variable k is decreased by 4 until k satisfying $R_{n+1}>\hat{C}_{k-4,n}$ is found at step S1315, S1316, and S1317. If k is found, variable m is set as m=k at step S1318 and then the value of variable m is decreased by 1 until m satisfying $R_{n+1}>\hat{C}_{m-1,n}$ is found at step S1319, S1320, and S1321. Once m is found, the ending point is set m−1 at step S1322.

Next, a search method for the LSP code book with a predictive SMQ is explained.

In an AMR codec of 10.2 kbps mode, 7.95 kbps mode, 7.40 kbps mode, 6.70 kbps mode, 5.90 kbps mode, 5.15 kbps mode, and 4.75 kbps mode, the LSP coefficients are quantized by a PSVQ (predictive split vector quantization) method, which is different from a case involving 12.2 kbps mode.

Figure 4:
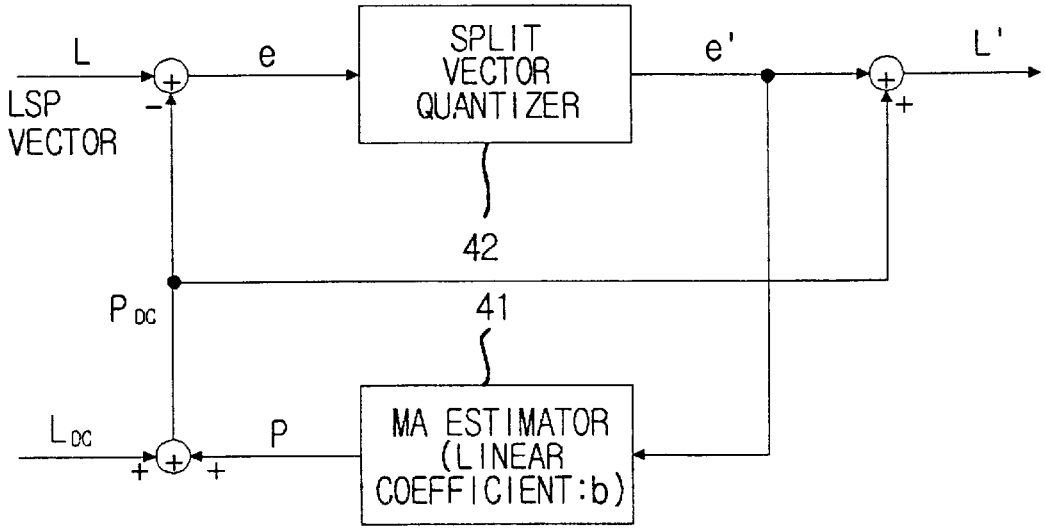
FIG. 4 is a block diagram illustrating the structure of PSVQ (predictive split vector quantization) of an AMR voice coder.

In 10.2 kbps mode, 7.95 kbps mode, 7.40 kbps mode, 6.70 kbps mode, 5.90 kbps mode, 5.15 kbps mode, and 4.75 kbps mode, a linear predictive analysis is performed once per one voice frame, with auto-correlation approximation method having a 30 msec asymmetric window. Also, to calculate auto-correlation, a 40 sample (5 msec) lookahead is used. Though an analysis window is same as the one used for 12.2 kbps, they are different in that $L_1^{(II)}$ and $L_2^{(II)}$ use 200 and 40, respectively. The LP filter coefficients are converted into LSP coefficients and then quantized. As shown in FIG. 4, a first order MA estimator 41 is employed and the residual LSF vector is quantized by SVQ 42. The expectation and quantization are performed as follows.

If the LSF vector is expressed by Z(n), resulted from subtracting the average from frame n, the expected residual LSF vector r(n) is described as equation 13.

$$r(n)=Z(n)-p(n) \qquad \text{[Equation 13]}$$

p(n): expected LSF vector regarding frame n

P(n) uses a first order MA estimator 41 and it is calculated from the residual LSF vector r'(n−1) and the expectation component $a_j$, regarding the jth order LSF. The following equation 14 shows this.

$$P_j(n)=a_j r'(n-1),\ j=1\ldots,10 \qquad \text{[Equation 14]}$$

Next, the residual LSF vector r(n) is quantized by a split vector quantization method. The vector r(n) is divided into 3 sub-vectors that are third order, third order and fourth order, respectively. According to each mode, three sub-vectors are quantized using 7, 8, or 9 bits. The quantization process for the seven modes are all the same except as the allocated number of bits is different for the sub-vectors. Here, the 7.95 kbps mode is explained as a representative case.

FIG. 4 is a block diagram illustrating the structure of a PSVQ (predictive split vector quantization) for an AMR voice coder. The MA estimator 41 is a first order MA estimator. Error vector e' is provided as input and first order expectation linear coefficient b is applied to the error vector e'. The result is expectation vector P. $P_{DC}$ is obtained by adding $L_{DC}$, the DC component of the LSP coefficient, to the expectation vector P. Error vector e is obtained by subtracting $P_{DC}$ from the LSP coefficient vector. The error vector e includes three sub-vectors and they are third order, third order and fourth order, respectively. Each sub-vector is quantized in 9 bit. Expectation vector $P_{DC}$ and the LSP error vector e are obtained by equation 15.

$$P_{DC}^{(i)}(n)=L_{DC}+b(n)e'^{(i-1)}(n)$$
$$e=L-P_{DC} \qquad \text{[Equation 15]}$$

i: current frame n: order of coefficient (n=1, . . . , 10)

The optimal code vector value, regarding each sub-vector, selected as error criterion $E_{l,m}$, is minimized. Equation 16 illustrates error criterion.

$$E_{l,m}=(L_m-L'_{l,m})^T W_m(L_m-L'_{l,m}),0\leqq m\leqq 2 \qquad \text{[Equation 16]}$$

$W_m$: priority matrix for mth sub-vector

Wm is obtained from L, a non-quantized LSP vector. Equation 17 illustrates the quantized LSP vector $L'_{l,m}$.

$$L'_{l,m}=P_{DC}+e'_{l,m},\ 0\leqq m\leqq 2 \qquad \text{[Equation 17]}$$

0≦l≦511

Error criterion $E_{l,m}$ is obtained by applying equation 17 to equation 16 and it is illustrated at equation 18.

$$E_{l,m}=(L_m-P_{DC}-e'_{l,m})^T W_m(L_m-P_{DC}-e'_{l,m})=((L_m-P_{DC})-e'_{l,m})^T W_m((L_m-P_{DC})-e'_{l,m})=(e_m-e'_{l,m})^T W_m(e_m-e'l,m)$$
$$0\leqq m\leqq 2 \qquad \text{[Equation 18]}$$

0≦l≦511

$e_m$: target vector for code book search $e'_{l,m}$: lth error vector of mth sub-vector p Since error criterion $E_{l,m}$ is represented by $e_m$ and $e'_{l,m}$, regarding 512 code books, the amount of calculation for $E_{l,m}$ is significantly reduced. Code book index l, minimizing error criterion $E_{l,m}$, is transmitted through the channel. When the LSP coefficients are quantized, most of the time is taken for searching optimal code vectors regarding three subvectors. Therefore, if scope for searching code vectors is reduced, the amount of calculation is definitely reduced.

In an embodiment of the present invention, a method to reduce the scope of the search is proposed. The method utilizes an ordering property of LSP coefficients. In conventional methods, since target vector $e_m$ and related code book are error vectors, they do not have an ordering property. In order to implement the target vector with an ordering property, equation 18 is evolved into equation 19.

$$E_{l,m}=(L_m-(P_{DC}+e'_{l,m}))^T W_m(L_m-(P_{DC}+e'_{l,m}))=(L_m-(\mathrm{i}\ L_{DC}+P_m+e'_{l,m}))^T W_m(L_m-(L_{DC}+P_m+e'_{l,m}))=((L_m-P_m)—(L_{DC}+e'_{l,m}))^T W_m((L_m-P_m)-(L_{DC}+e'_{l,m}))=(r_m-C_{l,m})^T W_m(r_m-C_{l,m})\ 0\leqq m\leqq 2 \qquad \text{[Equation 19]}$$

0≦l≦511

$E_{l,m}$ in the equation may be derived from $(L_m-P_m)$ and $(e'_{l,m}+L_{DC})$. If $(L_m-P_m)$ is $r_m$, $L_{DC}$ is not removed from $L_m$, and $P_m$ has small variance since it is predicted from error value. Therefore, $r_m$ has an ordering property and becomes a target vector for a code book search. If $(e'_{l,m}+L_{DC})$ is $C_{l,m}$, $C_{l,m}$ it has ordering property since $C_{l,m}$ results from addition existing error code book $e'_{l,m}$ to $L_{DC}$ that has an ordering property. Here, since $e'_{l,m}$ and $L_{DC}$ have all fixed values, they are pre-calculated and replace the existing code book.

Figure 6:
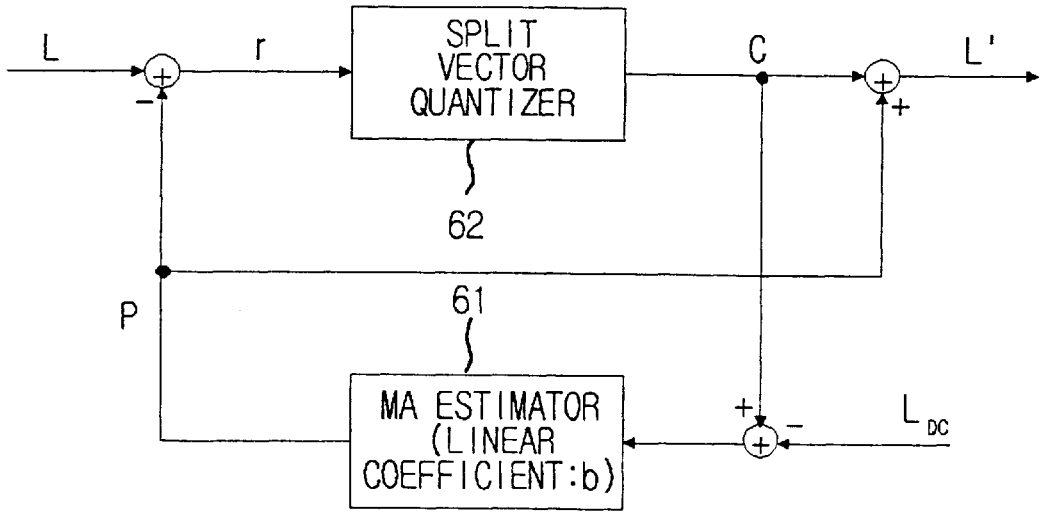
FIG. 6 is a block diagram illustrating the structure of PSVQ (predictive split vector quantization), in accordance with an embodiment of the present invention.

Like this, $E_{l,m}$ is derived from $r_m$ and $C_{l,m}$ and the code book index 1 value, minimizing $E_{l,m}$, is transmitted through a channel. FIG. 6 is a block diagram illustrating the structure of PSVQ (predictive split vector quantization) in accordance with an embodiment of the present invention. The structure shown in FIG. 6 is able to use the result of equation 19. The structure shown in FIG. 6 is basically the same as the structure shown in FIG. 4. However, they are different in that a procedure of $L_{DC}$ subtraction is omitted and the code book regarding each sub-frame is replaced by new code books. $L_{DC}$ is already added to the new code books. After this procedure, target vectors and related code books all have ordering property.

Figure 8:
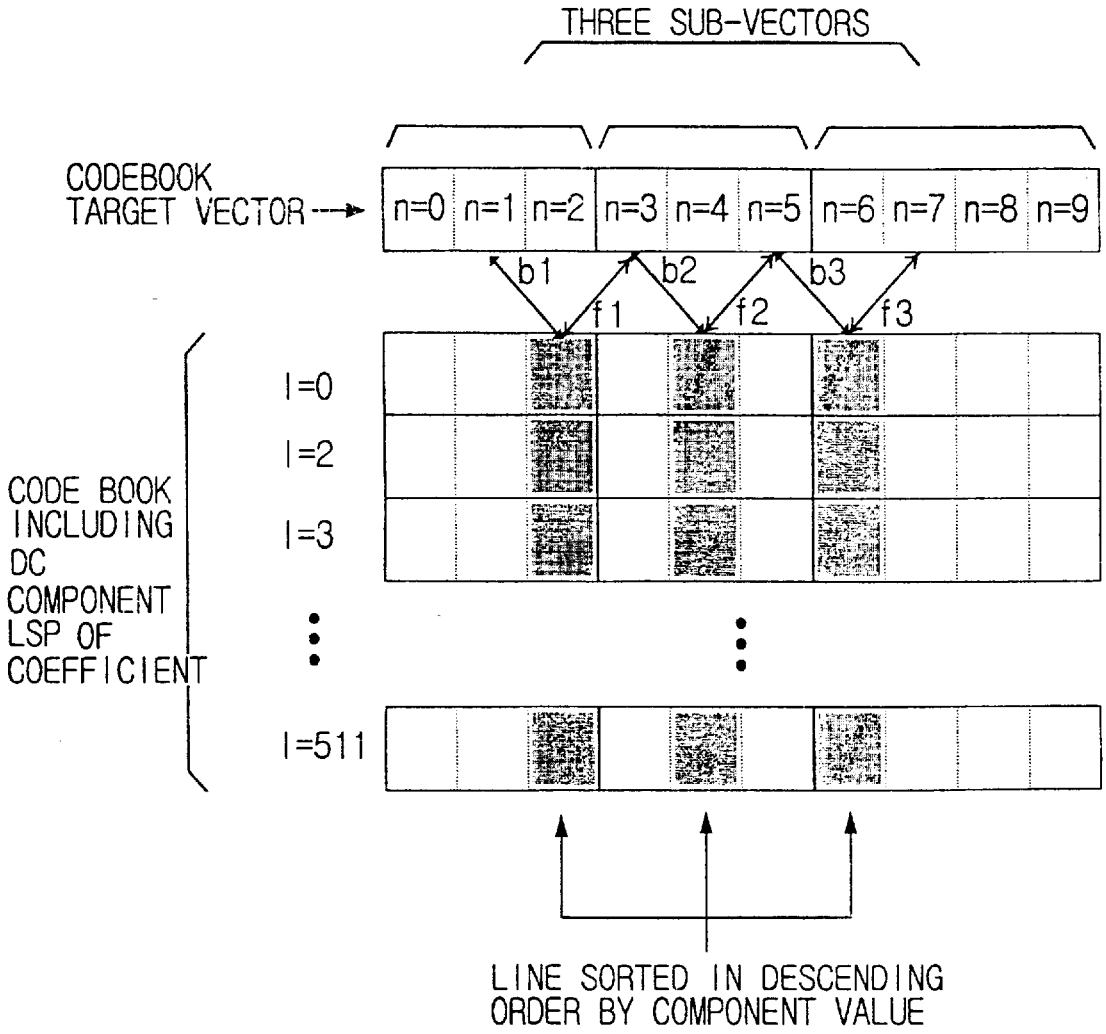
FIG. 8 is a block diagram illustrating a forward comparison method and a reverse direction comparison method when a search code vector is selected in a SVQ (split vector quantization)

FIG. 8 is a block diagram illustrating a forward comparison method and a reverse direction comparison method when a search code vector is selected in a SVQ (split vector quantization). As shown in FIG. 8, 3 subvectors are third order, third order, and fourth order respectively. The first code book is sorted in descending order with respect to the third line components. The second code book is sorted in descending order with respect to the second line components. The third code book is sorted in descending order with respect to the first line components. Since the sorted code book and target vector include the DC components, they maintain an ordering property. Therefore, the scope of the code book search is determined by the concept in which a particular line components the of code book are compared with a particular line component of target vectors, and code vectors violating ordering property are excluded.

$$r_{n+1}>C_{l,n}, 1\leqq l\leqq 512, n=2,4,6$$
$$r_{n-1}<C_{l,n}, 1\leqq l\leqq 512, n=2,4,6 \quad \text{[Equation 20]}$$

As shown in equation 20, it is called forward direction comparison if the nth line component of a code book is compared with the (n+1)th line component of the target vector. Also, it is called reverse direction comparison if the nth line component of a code book is compared with the (n−1)th line component of the target vector.

FIG. 8 is a block diagram illustrating a forward comparison method and a reverse direction comparison method, when a search code vector is selected in SVQ (split vector quantization). $f_1$, $f_2$, and $f_3$ represent component values in code books used for forward direction comparison and reverse direction comparison. $b_1$, $b_2$, and $b_3$ represent component values in the target vector used for forward direction comparison and reverse direction comparison.

Figure 11:
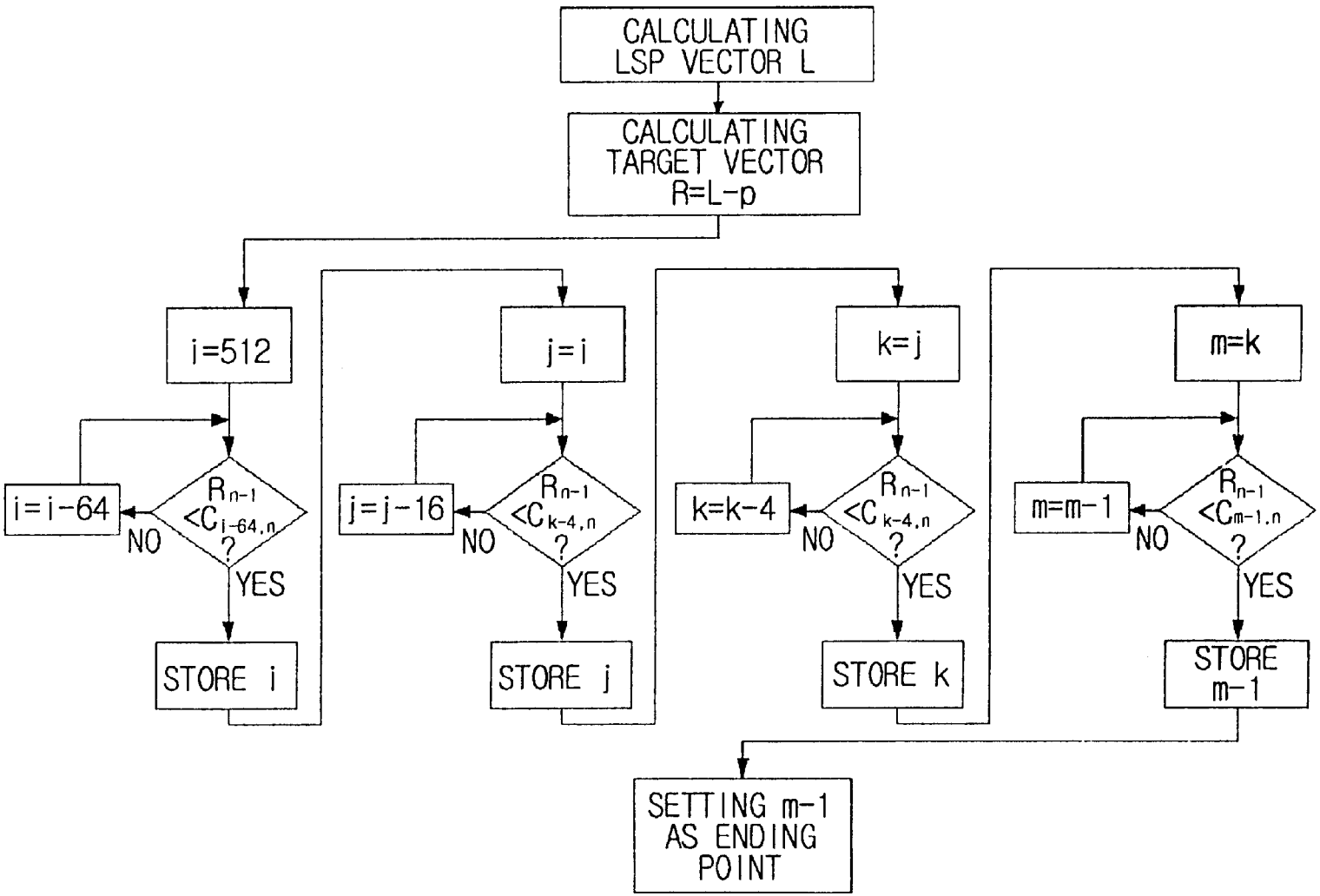
FIG. 11 is a flow diagram illustrating a reverse direction comparison method for obtaining an ending point of a code book search in a SVQ (split vector quantization)

Since each code book is sorted in descending order with respect to a particular line in the sub-matrix, the starting point of the search scope is obtained by forward direction comparison and the ending point of search scope is obtained by a reverse direction comparison. Likewise, the overall search scope satisfying an ordering property is obtained. Once the overall search scope is determined, the code book within the scope is searched and $E_{m,l}$ is achieved. FIG. 9 is a flow diagram illustrating a forward direction comparison method for obtaining the starting point of code book search. FIG. 11 is a flow diagram illustrating a reverse direction comparison method for obtaining the ending point of code book search in SVQ (split vector quantization).

An embodiment of the present invention utilizes an ordering property of LSP coefficients to reduce the searching scope for code vectors. Therefore, an efficient LSF quantizer, that reduces amount of time taken for code book search calculation, is successfully achieved.

Although representative embodiments of the present invention have been disclosed for illustrative purpose, those who are skilled in the art will appreciate that various modifications, additions and substitutions are possible without departing from the scope and spirit of the present invention as defined in the accompanying claims.

What we claim:

1. A fast search method for LSP (Linear Spectrum Pair) quantization, comprising:

a first step of obtaining a target vector and a code vector, the target vector and the code vector are converted for ordering property;

a second step of generating a code book having the ordering property for sub-matrices by utilizing the target vector and the code vector;

a third step of selecting a particular line for determining a search scope in the code book and sorting the code book in a regular order with respect to component values of the particular line;

a fourth step of determining the search scope by utilizing an ordering property of the target vector and the sorted code vectors; and a fifth step of obtaining an error standard by utilizing the target vector and the code vector, and obtaining an optimal code vector by utilizing the error standard within the determined search scope, wherein the first step comprises:

a first sub-step of obtaining a target vector of mth sub-matrix with an ordering property obtained by utilizing an LSP vector average value of mth sub-matrix and an expectation value of mth sub-matrix;

a second sub-step of obtaining an lth code vector of mth sub-matrix by utilizing an lth error code book of mth sub-matrix and an lth DC component of mth sub-matrix, lth DC component of mth sub-matrix having an ordering property; and a third sub-step of obtaining an error standard by utilizing the target vector of mth sub-matrix and the lth code vector of mth sub-matrix and determining a code book index that minimizes the error standard.

2. The fast search method of claim 1 wherein the error standard is obtained by applying the target vector of mth sub-matrix and the lth code vector of mth sub-matrix to the following equation 1 and equation 2:

$$\begin{aligned} E_{m,l} &= \sum_{i=0}^{3} [(r_{m,i} + L_{DC,m,i} - r'_{m,l,i} - L_{DC,m,i})w_{m,i}]^2 \\ &= \sum_{i=0}^{3} [\{(L_{m,i} - p_{m,i}) - (r'_{m,l,i} + L_{DC,m,i})\}w_{m,i}]^2 \\ &= \sum_{i=0}^{3} [(R_{m,i} - C_{m,l,i})w_{m,i}]^2 \\ &= \min(E_{m,l}, E_{m,l}^{(+)}) \end{aligned} \quad \text{[Equation 1]}$$

$$\begin{aligned} E_{m,l}^{(+)} &= \sum_{i=0}^{3} [(R_{m,i} - C_{m,l,i} - 2L_{DC})w_{m,i}]^2 \\ R_{m,i} &= L_{m,i} - P_{m,i}, \\ C_{m,l,i} &= r'_{m,l,i} + L_{DC,m,i} \end{aligned} \quad \text{[Equation 2]}$$

where $E_{m,l}$: error standard value for lth code vector of mth sub-matrix, $r_{m,i}$: target vector for ith component of mth sub-matrix, $L_{DC,m,i}$: average vector(DC component of LSP coefficient) for ith component of mth sub-matrix, $r'_{ml,i}$: codebook vector for ith component of lth code vector of mth sub-matrix, $w_{m,i}$: weighting matrix for ith component of mth sub-matrix, obtained non-quantized LSP vector, $L_{m,i}$: LSP coefficient for ith component of mth sub-matrix, $P_{m,i}$: prediction vector for ith component of mth sub-matrix, $R_{m,i}$: target vector of codebook search for ith component of mth sub-matrix with ordering property, $C_{m,l,i}$: reconstructed codebook vector for ith component of lth code vector of mth sub-matrix, and $L_{DC}$: average vector(DC component of LSP coefficient).

3. The fast search method of claim 1 wherein the DC component is the LSP vector average value.

4. The fast search method of claim 1 wherein the sub-matrices are composed of five sub-matricy, wherein the third step comprises:

a first sub-step of selecting a fourth line for a first code book, a third line for second code book, a third code book, and a fourth code book, and a fourth line for a fifth code book as a particular line; and a second sub-step of sorting a whole code book in descending order with respect to the selected particular line.

5. The fast search method of claim 4 wherein the fourth step comprises:

a first sub-step of sorting the third code book in ascending order by subtracting DC component from the third code book, multiplying a result of the subtraction by −1, and adding the DC component, if a sign bit of third code book is 1, the third code book being sorted in descending order by the ordering property;

a second sub-step of obtaining a starting point of the search scope by reverse comparison, the reverse comparison comparing nth line component of the sorted third code book with the (n−1)th line component of the target vector; and a third sub-step of obtaining an ending point of the search scope by forward comparison, the forward comparison comparing the nth line component of the sorted third code book with the (n+1)th line component of the target vector.

6. The fast search method of claim 5 wherein the process of obtaining the starting point obtains the smallest value satisfying $R_{n+1}>C_{l,n}$, with $R_{n+1}$ being the n+1th target vector for a code book search of sub-matrix, and $C_{i,n}$ being the nth code vector of lth sub-matrix.

7. The fast search method of claim 5 wherein the initial value of i is set at 128 for setting the starting point of the first code book search, 256 for setting the starting point of the second code book search, third code book search, and fourth code book search, and at 64 for setting the starting point of the fifth code book search.

8. The fast search method of claim 1 wherein the fourth step of obtaining a starting point of the search scope by forward direction comparison and an ending point of the search scope by a reverse direction comparison, the forward direction comparison comparing nth line component of the sorted code book with an (n+1)th line component of target vector, the reverse direction comparison comparing nth line component of the sorted code book with the (n−1)th line component of target vector.

9. The fast search method of claim 8 wherein the process of obtaining the ending point obtains the smallest l satisfying $R_{n-1}<C_{l,n}$, with $R_{n-1}$ being n-1th target vector for code book search of sub-matrix, and $C_{l,n}$ being nth code vector of lth sub-matrix.

10. The fast search method of claim 9 wherein the process of obtaining the ending point comprises:

a first sub-step of setting an initial value of i based upon an index number of each code book;

a second sub-step of finding i satisfying $R_{n-1}>C_{i-64,n}$ by decreasing i by 64;

a third sub-step of setting variable j=i and finding j satisfying $R_{n-1}>C_{j-16,n}$ by decreasing j by 16;

a fourth sub-step of setting variable k=j and finding k satisfying $R_{n-1}>C_{k-4,n}$ by decreasing k by 4;

a fifth sub-step for setting variable m=k and finding m satisfying $R_{n-1}>C_{m-1,n}$ by decreasing m by 1; and a sixth sub-step for setting the m+1 as ending point l.

11. The fast search method of claim 10 wherein the initial value of i is set at 128 for setting the ending point of the first code book search, 256 for setting the ending point of the second code book search, third code book search, and fourth code book search, and at 64 for setting the ending point of the fifth code book search.

12. The fast search method of claim 8 wherein the process of obtaining the starting point obtains the smallest l satisfying $R_{n+1}>C_{l,n}$, with $R_{n+1}$ being the n+1th target vector for a code book search of sub-matrix, and $C_{l,n}$ being the nth code vector of lth sub-matrix.

13. The fast search method of claim 12 wherein the process of obtaining the starting point comprises:

a first sub-step of initializing i to 0, and finding i satisfying $R_{n+1}>C_{i+64,n}$ by increasing i by 64;

a second sub-step of setting variable j=i and finding j satisfying $R_{n+1}>C_{j+16,n}$ by increasing j by 16;

a third sub-step of setting variable k=j and finding k satisfying $R_{n+1}>C_{k+4,n}$ by increasing k by 4;

a fourth sub-step of setting variable m=k and finding m+1 satisfying $R_{n+1}>C_{m+1,n}$ by increasing m by 1; and a fifth sub-step for setting the m+1 as a starting point.

* * * * *